US011753235B2

(12) United States Patent
Polloni et al.

(10) Patent No.: US 11,753,235 B2
(45) Date of Patent: Sep. 12, 2023

(54) PACK FOR SMOKING ARTICLES WITH A SLIDING OPENING

(71) Applicant: G.D SOCIETA' PER AZIONI, Bologna (IT)

(72) Inventors: Roberto Polloni, Bologna (IT); Luca Paradiso, Bologna (IT); Luca Federici, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 27 days.

(21) Appl. No.: 17/631,319

(22) PCT Filed: Jul. 31, 2020

(86) PCT No.: PCT/IB2020/057248

§ 371 (c)(1),
(2) Date: Jan. 28, 2022

(87) PCT Pub. No.: WO2021/019504

PCT Pub. Date: Feb. 4, 2021

(65) Prior Publication Data

US 2022/0258958 A1 Aug. 18, 2022

(30) Foreign Application Priority Data

Aug. 1, 2019 (IT) ..... 102019000013647

(51) Int. Cl.
*B65D 85/10* (2006.01)
*B65D 5/38* (2006.01)

(52) U.S. Cl.
CPC ..... *B65D 85/1036* (2013.01); *B65D 5/38* (2013.01); *B65D 2215/02* (2013.01)

(58) Field of Classification Search
CPC ... B65D 5/38; B65D 85/1036; B65D 2215/02
(Continued)

(56) References Cited

U.S. PATENT DOCUMENTS 3,881,599 A * 5/1975 Flaherty ..... B65D 85/1036 206/273
7,565,969 B2 * 7/2009 He ..... B65D 7/26 206/251

(Continued)

FOREIGN PATENT DOCUMENTS

EP 2143663 A1 1/2010
JP 2017-171364 A 9/2017

(Continued)

OTHER PUBLICATIONS

International Search Report and Written Opinion for Corresponding International Application No. PCT/IB2020/057248 dated Nov. 11, 2020.

(Continued)

*Primary Examiner* — Luan K Bui
(74) *Attorney, Agent, or Firm* — MARSHALL, GERSTEIN & BORUN LLP

(57) ABSTRACT

A pack for smoking articles comprising: a group of smoking articles housed in an inner container; an outer container, housing on the inside and in a sliding manner, the inner container; and a locking system. The locking system comprises an abutment element integral with and arranged inside the outer container; a first wing integral with the inner container and movable relative thereto so as to be arranged in abutment against the abutment element when the inner container is in a closed position, thus preventing the inner container from sliding from the closed position to an open position; and a second wing obtained on and movable relative to the outer container so as to be pressed inwards and, hence, move the underlying first wing accordingly to release the first wing abutting against the abutment element and allow the inner container to slide from the closed position to the open position.

8 Claims, 8 Drawing Sheets

(58) Field of Classification Search
USPC ..... 206/1.5, 265, 267, 268, 270, 468; 229/125.125
See application file for complete search history.

(56) References Cited

U.S. PATENT DOCUMENTS

| | | | | |
|---|---|---|---|---|
| 7,624,860 | B2 * | 12/2009 | Roila | B65D 85/1036 206/268 |
| 8,550,241 | B2 * | 10/2013 | Holford | B65D 85/1036 229/148 |
| 9,033,141 | B2 * | 5/2015 | Ghini | B65D 85/1036 206/268 |
| 2009/0045084 | A1 * | 2/2009 | Roila | B65D 85/1036 206/268 |
| 2011/0062037 | A1 * | 3/2011 | Bertuzzi | B65D 5/38 206/267 |
| 2013/0140201 | A1 * | 6/2013 | Ghini | B65D 85/1036 206/267 |

FOREIGN PATENT DOCUMENTS

| | | | |
|---|---|---|---|
| WO | WO-2011/154822 | A1 | 12/2011 |
| WO | WO-2013/028105 | A1 | 2/2013 |
| WO | WO-2013/110412 | A1 | 8/2013 |
| WO | WO-2019/141897 | A1 | 7/2019 |

OTHER PUBLICATIONS

Italian Search Report and Opinion for Corresponding Italian Application No. 201900013647, dated Mar. 10, 2020.

* cited by examiner

PACK FOR SMOKING ARTICLES WITH A SLIDING OPENING

CROSS-REFERENCE TO RELATED APPLICATIONS

This Patent Application is a U.S. national phase of International Patent Application No. PCT/IB2020/057248 filed Jul. 31, 2020, which claims the benefit of priority from Italian patent application no. 102019000013647 filed on Aug. 1, 2019, the respective disclosures of which are each incorporated herein by reference in their entireties.

TECHNICAL FIELD

The present invention relates to a pack for smoking articles with a sliding opening.

The present invention finds advantageous application to a pack of cigarettes with a sliding opening, to which the following description will make explicit reference without thereby losing generality.

In this text, in fact, reference will be made indifferently to the specific example of "cigarettes" rather than to the more generic expression "smoking articles", without however losing generality in relation to other types of articles (such as cigars, small cigars or cigarillos, electronic type cigarettes or ecigs, auxiliary products such as filters, refills for ecigs and other products based on tobacco or alternative components or tobacco substitutes).

BACKGROUND ART

Rigid packs for cigarettes with a hinged lid are the most popular packs of cigarettes currently on the market as they are simple to make, are easy and practical to use and offer a good mechanical protection to the cigarettes contained on the inside thereof.

In addition to the aforementioned rigid packs of cigarettes with a hinged lid, rigid packs of cigarettes with a sliding (or slidable) opening have been proposed comprising two containers inserted one inside the other in a partially separable manner.

In other words, a rigid pack of cigarettes with a sliding opening comprises an inner container, which is designed to receive a group of cigarettes wrapped in a wrapping sheet of metallized paper and is housed inside an outer container so as to slide relative to the outer container between a closed position, in which the inner container is inserted inside the outer container, and an open position, in which the inner container is partially extracted from the outer container. The sliding of the inner container relative to the outer container can be determined by a translation between the two containers, or by a rotation between the two containers around a hinge that connects the two containers.

A drawback that has been observed in rigid packs of cigarettes with a sliding opening is that in some situations, typically when the pack of cigarettes is inside a relatively large bag or pocket or if handled by a child it may unintentionally open. It is evident that the involuntary opening of the pack of cigarettes is undesirable, as it leads to the spilling of cigarettes and/or tobacco dust from the inner container.

The opening of a pack of cigarettes of the sliding type is simple and intuitive even for a child and therefore a sliding pack of cigarettes cannot be classified as "child-proof" or "child resistant", i.e. able to prevent children from opening the same. Normally, a pack of cigarettes is classified as "child-proof" if the opening thereof, i.e. the possibility of accessing the content, is precluded by mechanisms that an unknowing user would not be able to unlock. In other words, a pack of cigarettes is defined as "child-proof" when the opening thereof (and therefore access to the content) is non-trivial and requires the application of specific force or torque at predetermined points, or sequences of non-intuitive movements for the actual unlocking of the opening of the pack of cigarettes.

In the slide-opening rigid packs of cigarettes described in JP2017171364A, WO2019141897A1 and WO2013028105A1 a locking system is provided, which prevents the inner container from sliding from the closed position to the open position. The locking system comprises an abutment element and a pair of wings. The abutment element is integral with the outer container and is arranged inside the same. One of the two wings, or rather the inner one, is integral and movable relative to the inner container to be arranged abutting against the abutment element when the inner container is in the closed position in order to prevent the sliding of the inner container from the closed position to the open position. While, the other wing, or rather the outer one, is obtained on the outer container so as to be pressed inwards and then consequently move the underlying inner wing in order to unlock the locking system and allow the inner container to slide from the closed position to open position. In these packs, however, the locking system is arranged at the side walls (i.e. the walls which are parallel to a prevailing development direction of the pack and which have a greater width than the front and rear walls). Typically, packs with a sliding opening are grasped precisely at the side walls by the user and therefore the locking system is unlocked involuntarily even during the simple holding of the pack, perhaps without having the intention of wanting to unlock it at that moment, or by means of the application of a lateral compression caused by the containment, for example in a bag or a trouser or jacket pocket. As a result, the packs described above have a locking system that can be easily opened, without the application of particular force or torque and without having to perform a particular sequence of movements for the actual unlocking of the opening of the pack of cigarettes. Therefore, the locking systems described in JP2017171364A, WO2019141897A1 and WO2013028105A1 do not guarantee an effective locking of the pack itself in order to prevent children from opening the same.

DISCLOSURE OF INVENTION

The object of the present invention is, therefore, to provide a pack for smoking articles with a sliding opening which is free from the drawbacks of the state of the art, and which is easy and inexpensive to manufacture.

According to the present invention, a pack for smoking articles with a sliding opening is provided as claimed in the attached claims.

BRIEF DESCRIPTION OF THE DRAWINGS

The present invention will now be described with reference to the attached drawings, which illustrate some non-limiting embodiments, wherein.

BEST MODE FOR CARRYING OUT THE INVENTION

Figure 2:
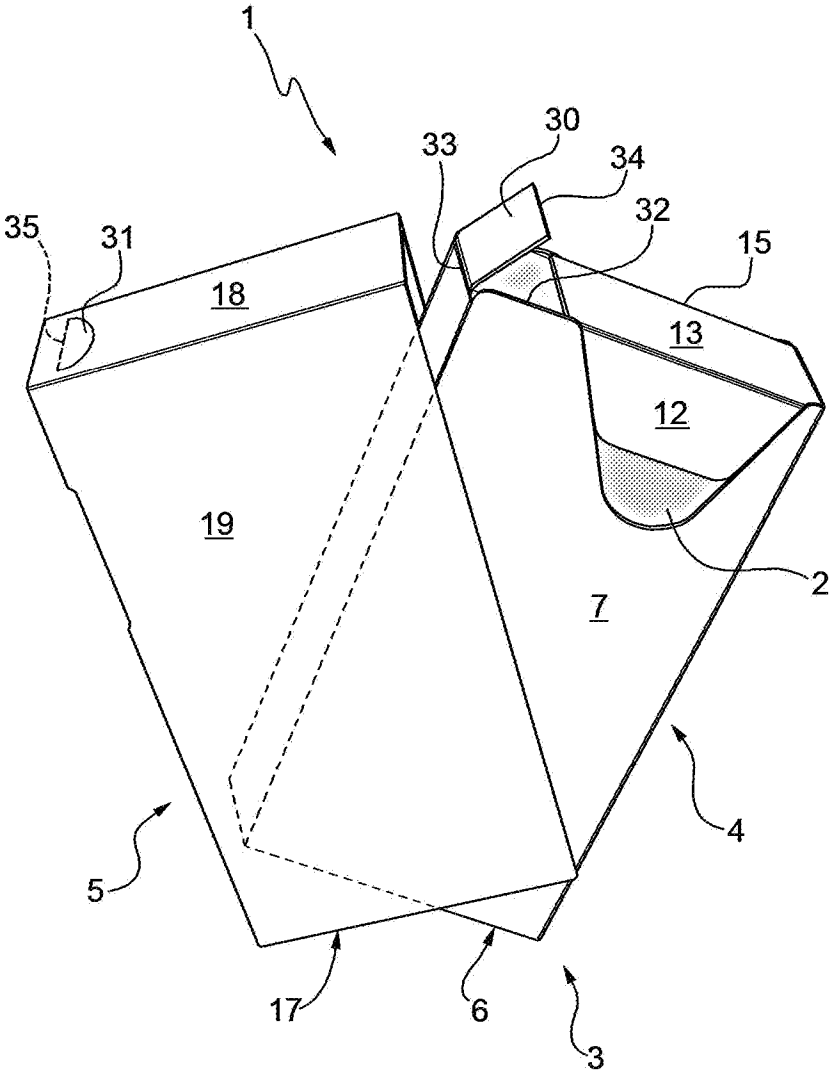
FIG. 2 is a perspective view in an open configuration of the pack of cigarettes of FIG. 1, with a sliding opening by way of rotation.
Figure 1:
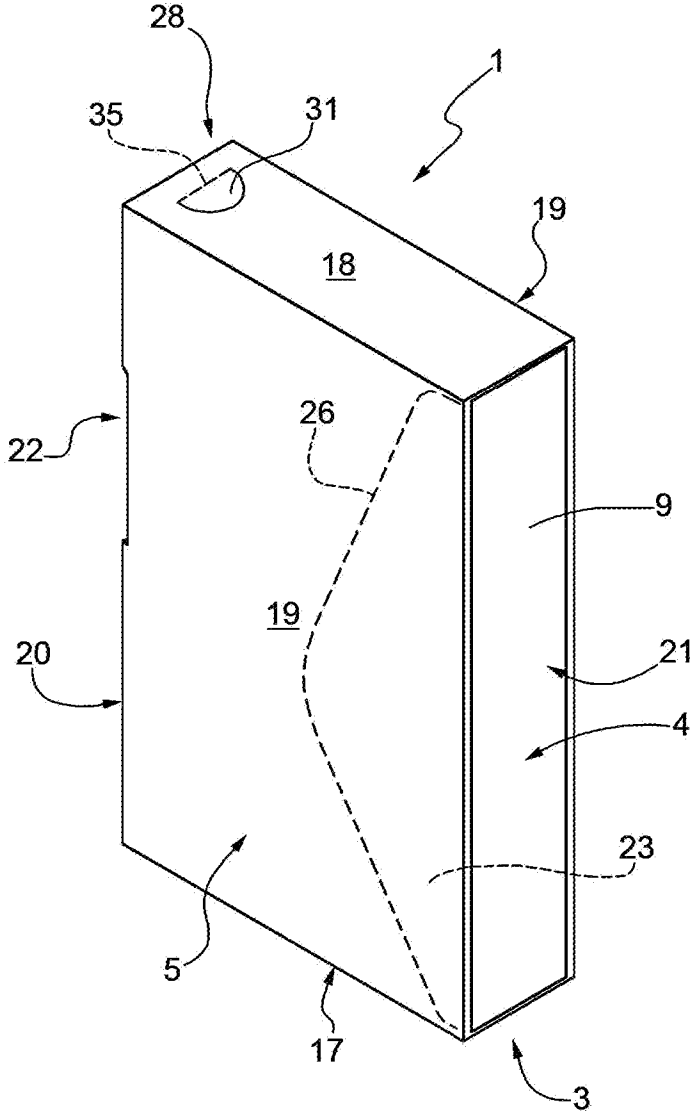
FIG. 1 is a perspective view in a closed configuration of a rigid pack of cigarettes with a sliding opening obtained according to the present invention.
Figure 3:
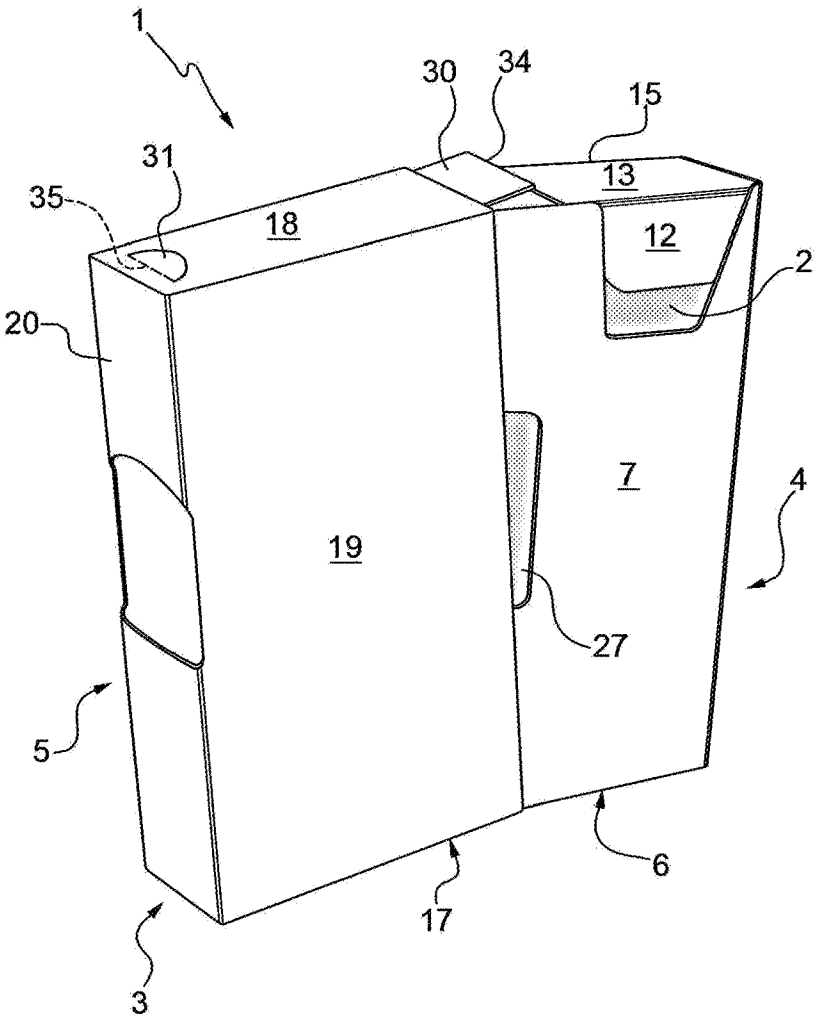
FIG. 3 is a perspective view in an open configuration of the pack of cigarettes of FIG. 1, with a sliding opening by way of translation.

In FIG. 1, number 1 denotes as a whole a rigid pack of cigarettes with a sliding opening by way of rotation (circular movement illustrated in FIG. 2) or translation (linear movement illustrated in FIG. 3).

In the following description of the pack 1 of cigarettes, terms such as "bottom", "top", "front" and "back" will be used to designate the positions of portions of the pack 1, assuming that the pack is arranged in an arrangement such that the direction of its prevailing development (or axis of the cigarettes) coincides with the vertical direction; therefore the lower and upper walls are arranged "at the bottom" and "at the top", respectively, and the front and rear walls define the "front" and the "back" of the pack 1, respectively. The pack 1 of cigarettes illustrated in FIG. 1 comprises a wrapped group 2 of cigarettes (shown in FIGS. 2-6), i.e. a group (not illustrated) of cigarettes wrapped in a wrapping sheet of metallized paper, and a rigid outer casing 3 of cardboard or the like housing the wrapped group 2. The outer casing 3 in turn comprises an inner container 4 of the rigid type, inside which the wrapped group 2 is directly placed, and an outer container 5 of the rigid type, which houses the inner container 4 in a sliding manner so as to allow the inner container 4 to slide relative to the outer container 5 in order to move with a translation or rotation movement between a closed position (illustrated in FIG. 1), in which the inner container 4 is completely inserted inside the outer container 5, and an open position (illustrated in FIGS. 2 and 3), in which the inner container 4 is partially extracted from the outer container 5 so as to allow access to the wrapped group 2.

Figure 4:
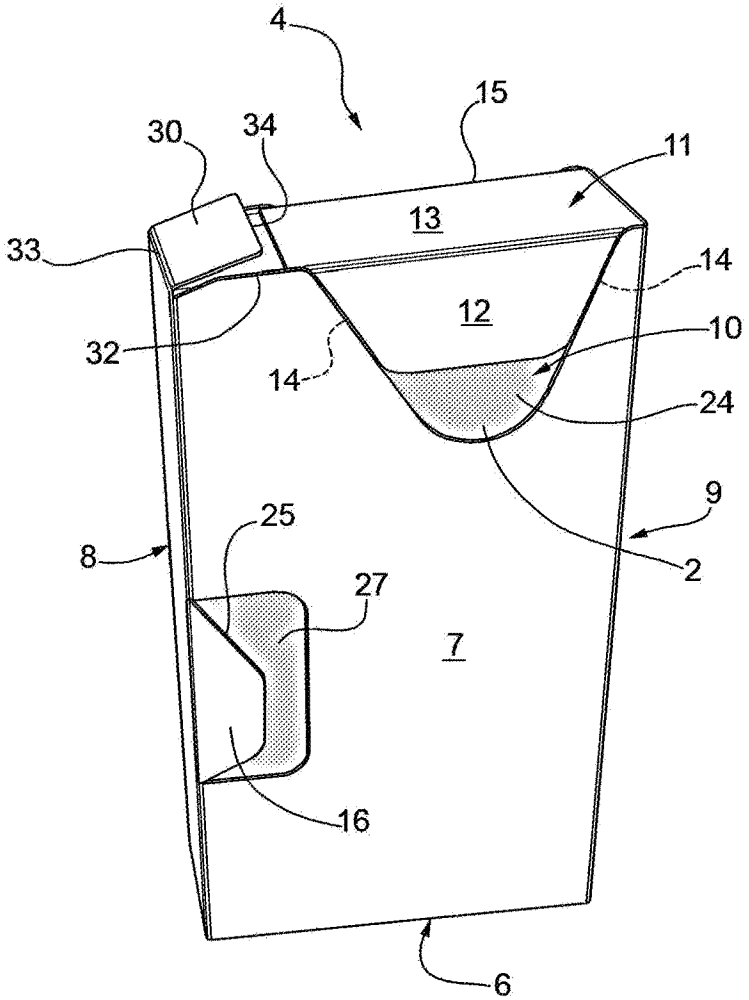
FIG. 4 is a perspective view of an inner container of the pack of cigarettes illustrated in FIGS. 1-3.

As illustrated in FIG. 4, the inner container 4 has a parallelepiped shape and has a lower wall 6, two side walls 7 parallel and opposite to one another and a rear wall 8 and a front wall 9 parallel to one another and interposed between the side walls 7. The inner container 4 comprises an open upper end, surrounded by an upper edge 32, thus being devoid of an upper wall. In particular, the side 7, rear 8 and front 9 walls are parallel to the prevailing development direction of the pack 1. While, the lower wall 6 is transverse, in particular orthogonal, to the prevailing development direction of the pack 1. As can be seen in the attached Figures, the side walls 7 have a width (size measured orthogonally to the prevailing development direction) which is greater than the width (measured similarly) of the rear 8 and front 9 walls.

The inner container 4 has an extraction opening 10 at each side wall 7. The pack 1 of cigarettes has a closing tab 11 configured to close, that is to say, at least partially cover the extraction opening 10. The closing tab 11 has two side walls 12 parallel and opposite to one another and an upper wall 13 interposed between the two side walls 12. The closing tab 11 is connected to the inner container 4, in particular at the respective side wall 7 of the inner container 4, by means of a respective tear-off separation line 14. In particular, each side wall 12 of the closing tab 11 is separated from each side wall 7 by means of the respective tear-off separation line 14. Therefore, the user can choose whether to completely tear the separation lines 14 and therefore remove the closing tab 11, after the first opening of the pack 1 of cigarettes, or whether to keep the closing tab 11 connected, at least partially, at a side wall 7 to obtain a repositionable closure of the extraction opening 10. In the latter case, the closing tab 11 rotates around a hinge 15 (illustrated for example in FIGS. 2-4), relative to the side wall 7, between an open position (not illustrated) and a closed position (illustrated in FIGS. 2-4).

As illustrated in FIG. 2-4, at least one of the two side walls 7 has a through hole 24 which surrounds at least a portion of the closing tab 11.

According to an alternative embodiment, the side walls 7 are devoid of the through hole 24 that surrounds at least a portion of the closing tab 11.

The extraction opening 10 is designed to be arranged, when the inner container 4 is in its open position, on the outside of the outer container 5 to allow the cigarettes (not illustrated) to be extracted from the inner container 4. In the case of the first opening of pack 1 of cigarettes, the user must lift the closing tab 11 and open the wrap of the wrapped group 2. In other words, the user lifts the side wall 12, by means of the through hole 24, tearing the separation line 14, rotating the closing tab 11 around the hinge 15 and then accessing the wrapped group 2 of cigarettes. The user can completely remove the closing tab 11, also by tearing the other separation line 14.

Four longitudinal edges are defined between each side wall 7 and each rear wall 8 and front wall 9 and four transverse edges are defined between each rear wall 8 and front wall 9 and the walls 6 and 7. The hinge 15 is arranged on a transverse edge of the closing tab 11 delimited by the front wall 12 and by the upper wall 13.

As is illustrated in FIG. 4, each side wall 7 has a respective stop tab 16 cut out near the rear wall 8, which extends towards the outside of the inner container 4 starting from the edge comprised between the side wall 7 and the rear wall 8.

The outer container 5 (illustrated in FIG. 1) also has a parallelepiped shape and has a lower wall 17, an upper wall 18, two side walls 19 parallel and opposite to one another, a rear wall 20 and an opening 21, which is opposite to the rear wall 20 and through which the inner container 4 is slidably mounted. In particular, the side 19 and rear 20 walls are parallel to the prevailing development direction of the pack 1. While, the lower 17 and upper 18 walls are transverse, in particular orthogonal, to the prevailing development direction of the pack 1. As can be seen in the attached Figures, the side walls 19 have a width (size measured orthogonally to the prevailing development direction) which is greater than the width (similarly measured) of the rear wall 20.

Two longitudinal edges are defined between each side wall 19 and the rear wall 20 and six transverse edges are defined between each side wall 19 and the walls 17 and 18. The rear wall 20 of the outer container 5 has a hole 22, which has shape and size such as to allow a user to exert, through the hole 22 and against the rear wall 20, a thrust on the rear wall 8 of the inner container 4 so as to slide the inner container 4 towards its open position. According to an alternative embodiment not illustrated, the hole 22 also involves a portion of the side walls 19 of the outer container 5.

Advantageously, a stop tab 23 (shown in broken line in FIG. 1) is connected, at the edge of the side wall 19 delimiting the opening 21, to each side wall 19 of the outer container 5, which stop tap is hinged to the side wall 19, is folded by 180° against the side wall 19, and may or may not be glued to an inner surface of the side wall 19.

According to a different embodiment, not illustrated, each stop tab 23 is not hinged to the side wall 19 of the outer container 5, but is initially completely separated from the side wall 19 and is at least partially glued to the inner surface of the side wall 19 only at a later time.

According to the embodiment illustrated in the attached figures, two stop tabs 16 are provided symmetrically protruding outwards from the side walls 7 of the inner container 4 and two corresponding stop tabs 23 protruding inwards from the side walls 19 of the outer container 5.

According to a different embodiment, not illustrated, a single stop tab 16 protruding outwards from a side wall 7 of the inner container 4 and a single corresponding stop tab 23 protruding inwards from a side wall 19 of the outer container 5 is provided.

The two stop tabs 16 of the inner container 4 and the two stop tabs 23 of the outer container 5 form a stop member which blocks the sliding of the inner container 4 relative to the outer container 5 when the inner container 4 is in the open position. In other words, the stop member limits the extraction stroke of the inner container 4 relative to the outer container 5 so as to prevent the complete exiting of the inner container 4 from the outer container 5. Each stop tab 16 has an edge 25 that delimits the profile of the stop tab 16 itself and faces the opening 21 of the outer container 5 (i.e. towards the front wall 9 of the inner container 4). Each stop tab 23 has an edge 26 which delimits the profile of the stop tab 23 itself and faces the edge 25 of the corresponding stop tab 16 (i.e. towards the rear wall 20 of the outer container 5 and towards the rear wall 8 of the inner container 4). The edge 26 of each stop tab 23 forms a mechanical stop against which the edge 25 is arrested during the opening movement of the inner container 4 and when the inner container 4 is in the open position, determining an end of stroke of the sliding of the inner container 4 relative to the outer container 5 thus preventing the complete exiting of the inner container 4 from the outer container 5.

According to a different embodiment, during the opening movement of the inner container 4, the stop tab 16 is inserted between the stop tab 23 and the side wall 19 of the outer container 5.

According to a preferred embodiment, each stop tab 16 is formed by a portion of a side wall 7 of the inner container 4 and is delimited by a through incision made through the side wall 7 and "U"-shaped. Preferably, each side wall 7 of the inner container 4 comprises a through hole 27 which surrounds the edge 25 of the stop tab 16.

According to the embodiments illustrated in FIGS. 1-6, the pack 1 of cigarettes comprises a locking system 28 which normally prevents the sliding of the inner container 4 from the closed position to the open position. The locking system 28 can be deactivated by means of an external action of the user, who allows the sliding of the inner container 4 from the closed position to the open position, and can be reactivated in an autonomous and automatic manner by moving the inner container 4 from the open position to the closed position. In other words, to allow the inner container 4 to slide relative to the outer container 5, the locking system 28 must be deactivated by the user. While, upon complete closure of the pack 1 of cigarettes, the locking system 28 is reactivated (as illustrated in FIG. 1) in an automatic and autonomous manner avoiding the opening of the pack 1 of cigarettes.

The locking system 28 comprises an abutment element 29 and two wings 30 and 31 obtained at the inner container 4 and of the outer container 5, respectively. The wing 30 normally protrudes outwards from an upper end of the inner container 4 and the wing 31 is obtained at the upper wall 18 of the outer container 5, which is transverse to the prevailing development direction of the pack 1, so as to at least partially overlap the wing 30, as will be described in detail hereinafter. The abutment element (illustrated in FIGS. 5 and 6) is integral with the outer container 5 and is arranged inside, that is, within, the outer container 5. In particular, the abutment element 29 is obtained at an inner surface of the upper wall 18 of the outer container 5.

Advantageously, since the upper wall 18 of the outer container 5 is formed by an outer panel 18' and by an inner panel 18" (illustrated in FIGS. 10, 11, 15 and 16) which overlap and are glued to one another, the abutment element 29 is defined by a transverse edge (illustrated in FIGS. 5 and 6) of the inner panel 18". In particular, the inner panel 18" is smaller than the outer panel 18'. In other words, the inner panel 18" has an extension (measured transversely to the longitudinal extension of the pack 1 of cigarettes and parallel to the side walls 19) which is smaller than the extension of the outer panel 18'(measured in a similar way) by an amount substantially equal to an extension (measured transversely to the longitudinal extension of the pack 1 of cigarettes and parallel to the side walls 7) of the wing 30 of the locking system 28.

Figure 11:
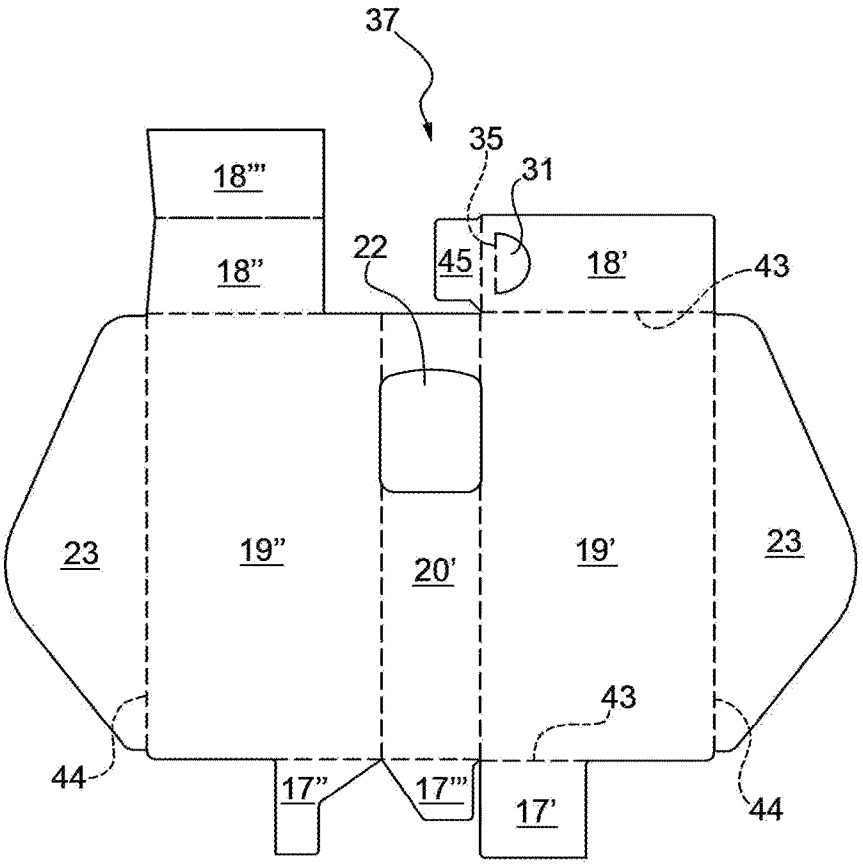
FIG. 11 is a plan view of a blank used to make the inner container of the pack of FIG. 2 and obtained according to a second embodiment.
Figure 16:
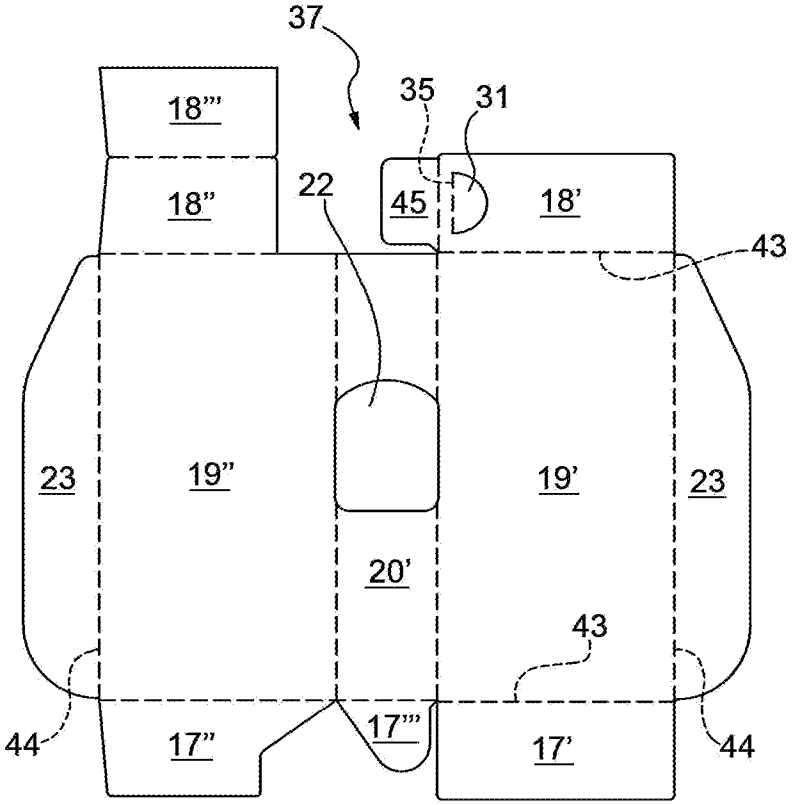
FIG. 16 is a plan view of a blank used to make the inner container of the pack of FIG. 3 and obtained according to a second embodiment.
Figure 15:
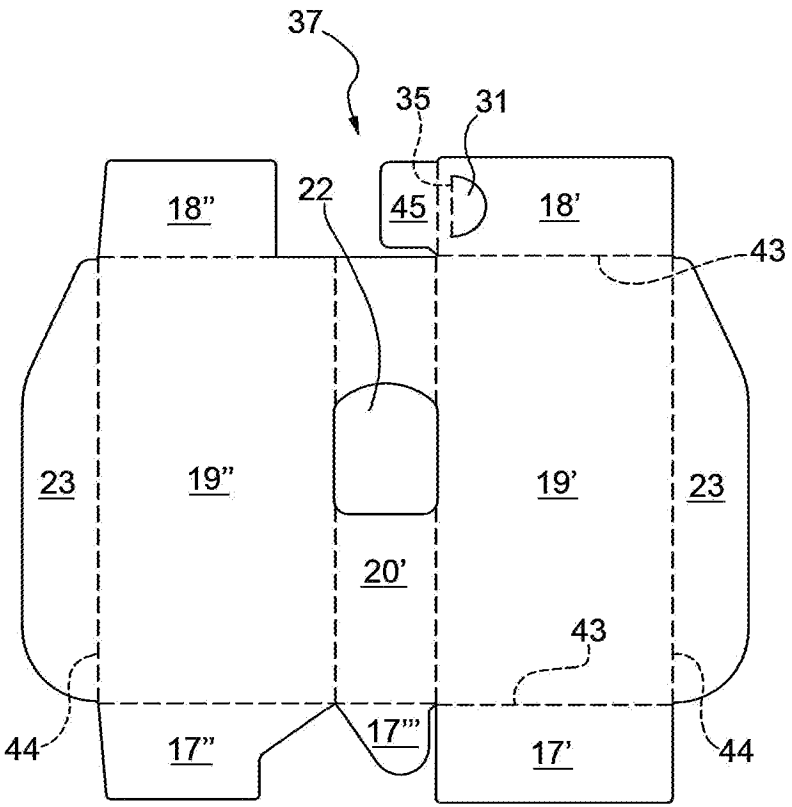
FIG. 15 is a plan view of a blank used to make the inner container of the pack of FIG. 3 and obtained according to a first embodiment.

As illustrated in FIGS. 11 and 16, the inner panel 18" has a reinforcement panel 18''' which is hinged to the inner panel 18", overlaps and is glued to the inner panel 18", and helps to define the abutment element 29. Substantially, according to this embodiment, the abutment element 29 is made by two overlapping panels 18" and 18'". Therefore, since the thickness of the abutment element 29 is greater, the strength and stiffness of the abutment element 29 increases.

The wing 30 (illustrated in FIGS. 2-6) is integral with the inner container 4, is movable relative to the inner container 4, and is configured to arrange a free end 34 thereof against the abutment element 29 of the outer container 5 when the inner container 4 is in the closed position, thus preventing the inner container 4 from sliding from the closed position to the open position. Therefore, if the abutment element 29 is more resistant and rigid, the better the contrast for abutment and also the maintaining of the locking of the wing 30 by means of the abutment element 29. In other words, by increasing the thickness of the abutment element 29 the ability increases for the abutment element 29 to hook, or rather, to create a mechanical constraint, with the wing 30.

The wing 30 is hinged to a wall of the inner container 4 along a hinge 33 (illustrated in particular in FIGS. 2 and 4). The wing 30 is hinged to the rear wall 8 of the inner container 4 along the hinge 33. Advantageously, the wing 30 has at least a portion having a transverse size greater than a transverse size of the rear wall 8 of the inner container 4. In other words, the wing 30 has at least one portion, such as the free end 34 (FIGS. 7 and 12) or the portion near the hinge 33 (FIGS. 8, 9, 13 and 14) which has a transverse size, i.e. measured along a direction transverse to the longitudinal extension of the pack 1 of cigarettes and parallel to the rear wall 8, greater than the size of the rear wall 8 to which the wing 30 is hinged, so as to guarantee the wing 30 to rest on the upper edge 32 of the inner container 4.

Figure 7:
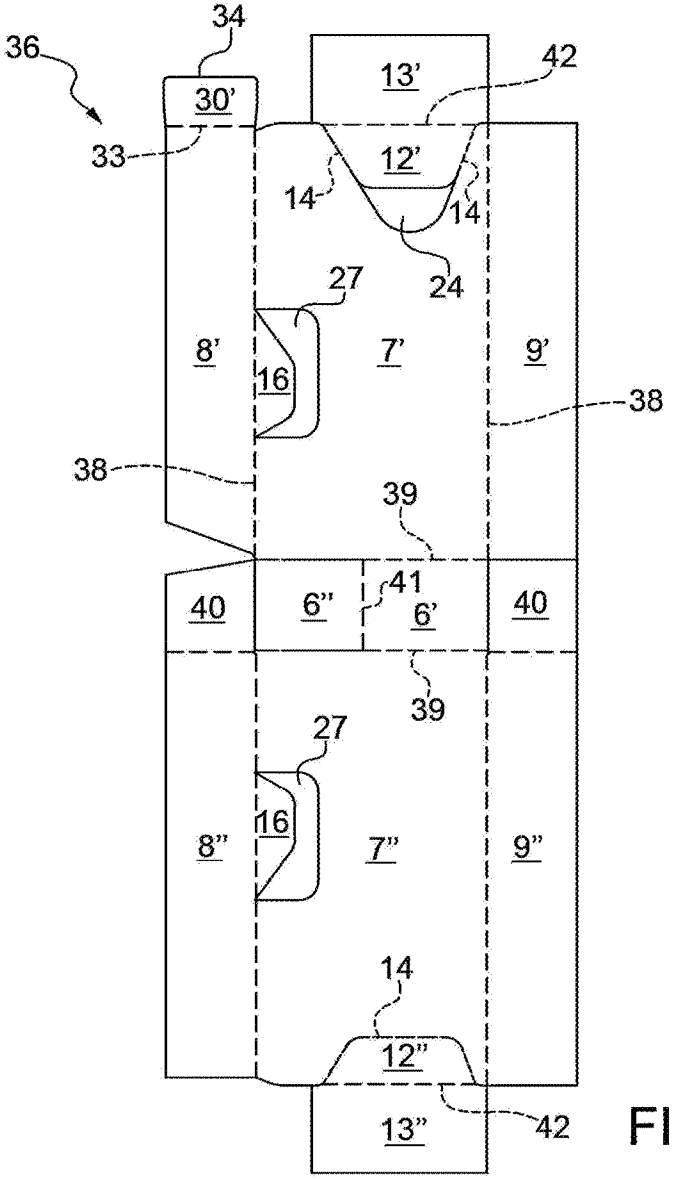
FIG. 7 is a plan view of a blank used to make the outer container of the pack of FIG. 2 and obtained according to a first embodiment.
Figure 12:
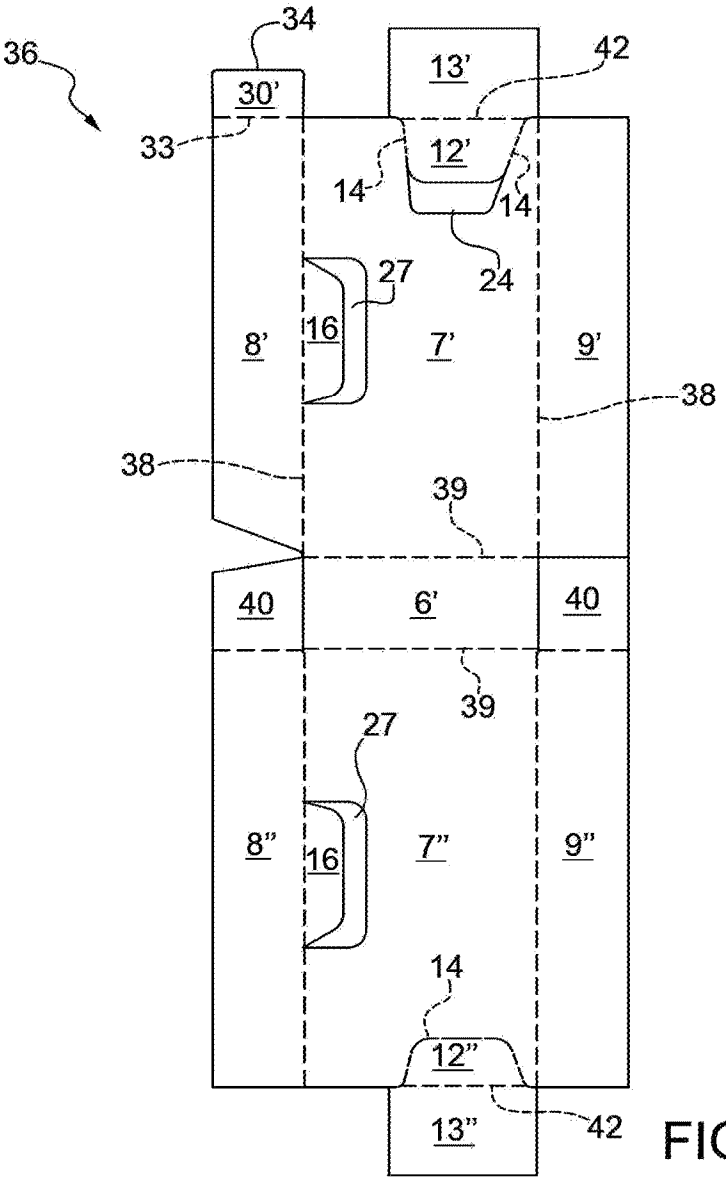
FIG. 12 is a plan view of a blank used to make the outer container of the pack of FIG. 3 and obtained according to a first embodiment.

Preferably the transverse size of the wing 30 is greater than the transverse size of the rear wall 8 (measured as stated above) by an amount preferably comprised between 0.5 and 1.5 millimetres and the transverse size of the wing 30 can be variable along the extension of the wing 30 itself, in a direction orthogonal to the rear wall 8, According to what is illustrated in FIGS. 7 and 12, the wing 30 has at least a portion with an increasing transverse size as it moves away from the hinge 33.

As illustrated in FIGS. 8, 9, 13 and 14, the wing 30 has the portion with the increasing transverse size adjacent to the hinge 33 and subsequently there is a portion with a decreasing transverse size.

The rear wall 8 of the inner container 4 is normally formed by an outer panel 8' and by an inner panel 8" which overlap and are glued to one another.

Figure 8:
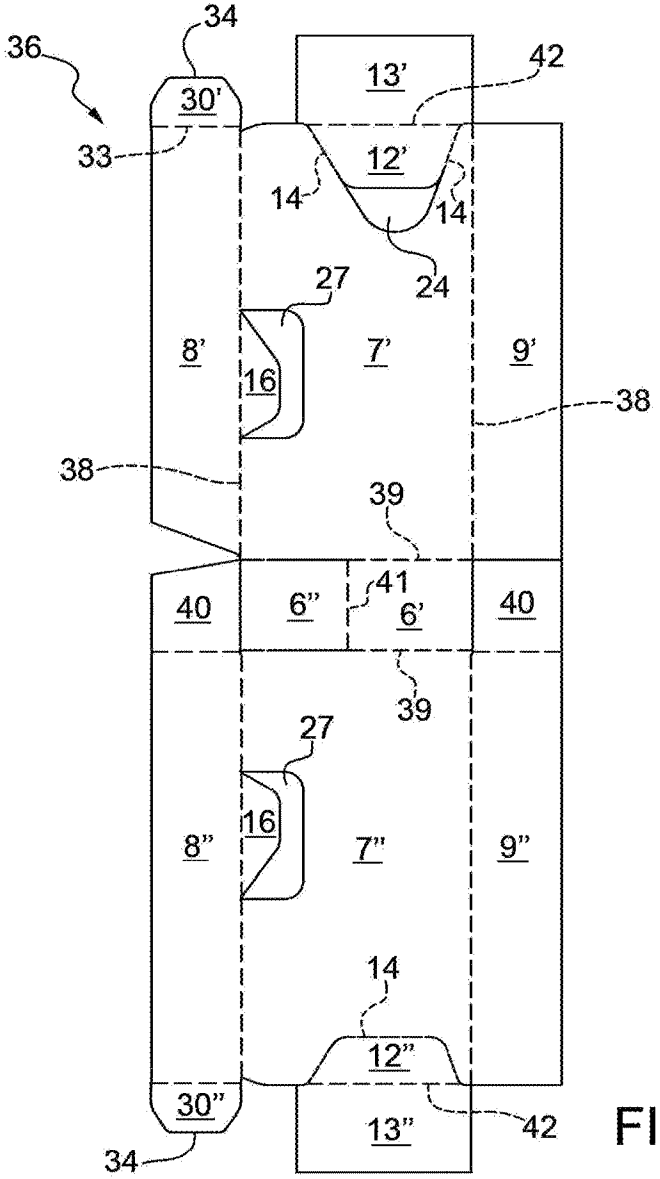
FIG. 8 is a plan view of a blank used to make the outer container of the pack of FIG. 2 and obtained according to a second embodiment.
Figure 9:
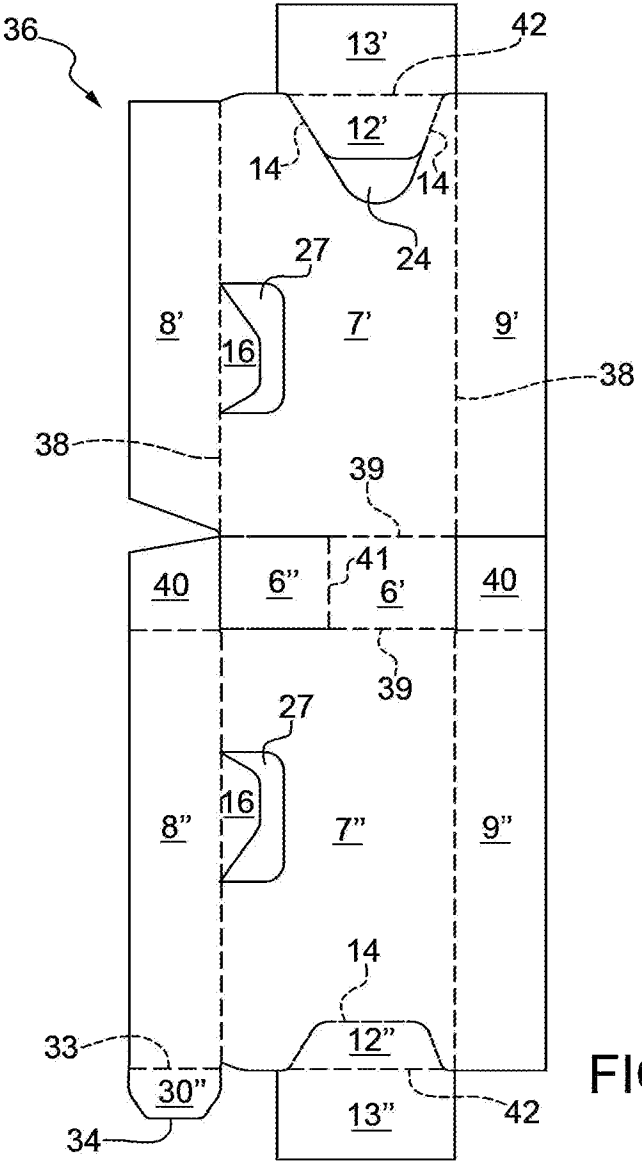
FIG. 9 is a plan view of a blank used to make the outer container of the pack of FIG. 2 and obtained according to a third embodiment.
Figure 14:
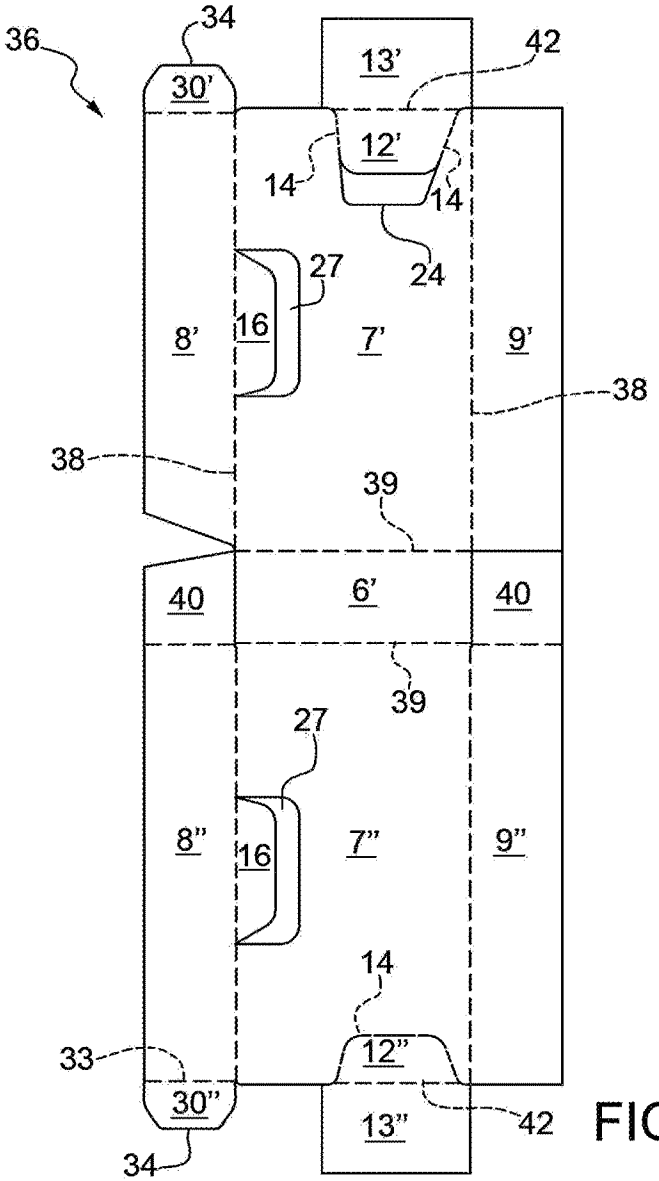
FIG. 14 is a plan view of a blank used to make the outer container of the pack of FIG. 3 and obtained according to a third embodiment.
Figure 13:
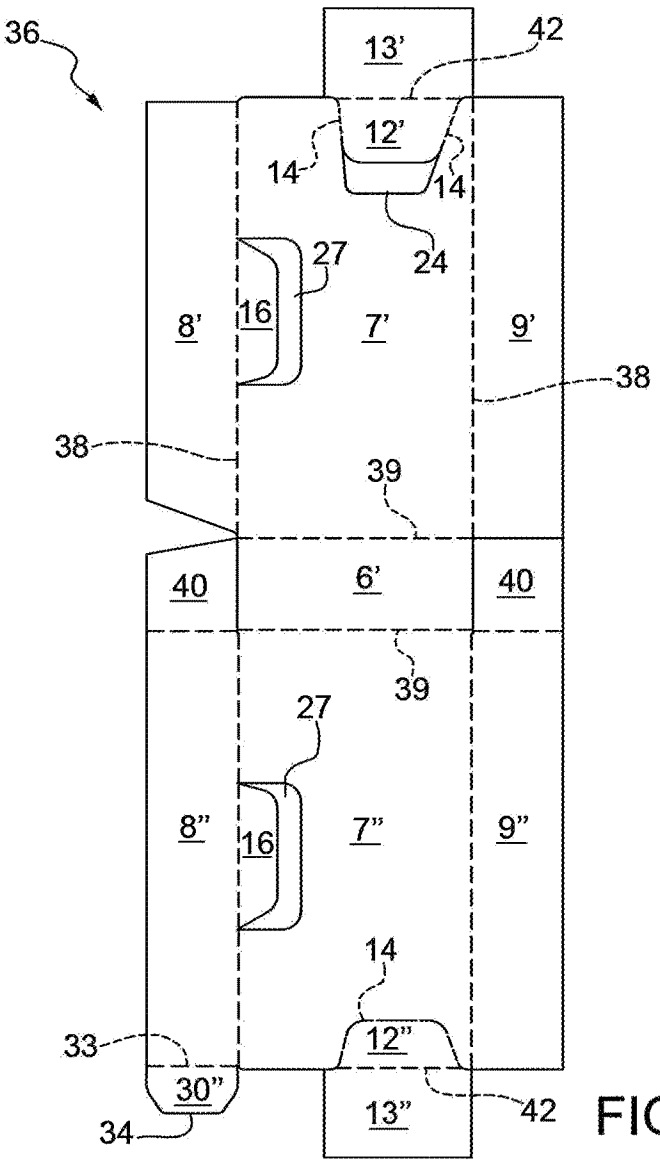
FIG. 13 is a plan view of a blank used to make the outer container of the pack of FIG. 3 and obtained according to a second embodiment.

As illustrated in FIGS. 7 and 12, the wing 30 is exclusively hinged to the outer panel 8' and is formed by a single outer portion 30'. As illustrated in FIGS. 9 and 13, the wing 30 is exclusively hinged to the inner panel 8" and is formed by a single inner portion 30". As illustrated in FIGS. 8 and 14, the wing 30 is formed by an inner portion 30" which is hinged to the inner panel 8" and by an outer portion 30' which is hinged to the outer panel 8' and overlaps and is glued to the inner portion 30". The portions 30' and 30" have the same size measured perpendicular to the rear wall 8 of the inner container 4.

In an alternative embodiment, the wing 30 is hinged to one of the side walls 7 of the inner container 4.

The other wing 31 of the locking system 28 is instead obtained on the outer container 5. In particular, the wing 31 (illustrated in FIGS. 1-3, 5 and 6) is obtained on the outer container 5, is arranged at the wing 30 (when the pack 1 of cigarettes is in the closed position), and is movable relative to the outer container 5 to be pressed inwards and then consequently move the underlying wing 30, in order to release the first wing 30 abutting against the abutment element 29 and, by so doing, allow the inner container 4 to slide from the closed position to open position.

The wing 31 is hinged to a wall of the outer container 5 along a hinge 35 (illustrated in FIGS. 1-3, 5 and 6). In particular, the wing 31 is hinged to the upper wall 18 of the outer container 5 along the hinge 35. As illustrated in the attached Figures and as previously described, the wing 31 is obtained at the upper wall 18 of the outer container 5 so as to at least partially overlap the wing 30.

When the locking system 28 is activated (FIG. 5), the free end of the wing 30 is arrested (i.e. creates a mechanical constraint) against the abutment element 29, thus preventing the inner container 4 from sliding relative to the outer container 5, while the wing 31 is coplanar with the upper wall 18 of the outer container 5 or slightly raised towards the outside.

Figure 5:
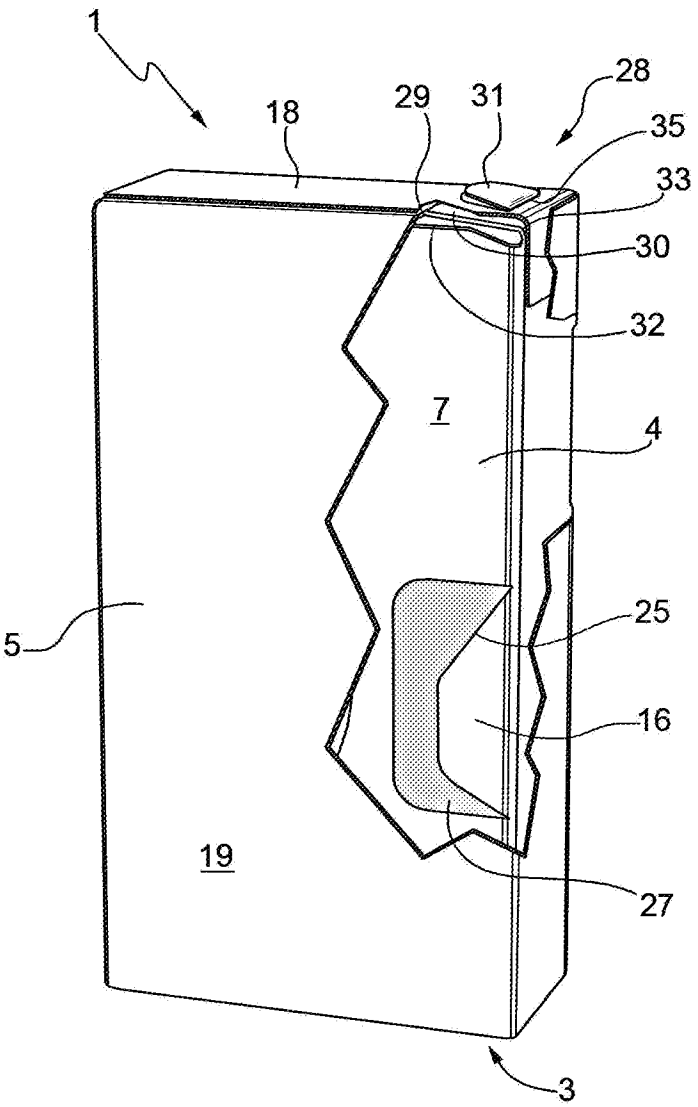
FIG. 5 is a perspective view, with some parts removed for clarity, of the pack of cigarettes of FIG. 1 with an activated locking system.

When the locking system 28 is deactivated (FIG. 6), the inner container 4 is still arranged in the closed position, the wing 31 is operated towards the inside of the outer container 5 by the user, and in turn acts upon the wing 30 which then disengages the abutment element 29, to be arranged towards the inner container 4. In other words, by lowering the wing 31, the latter acts and lowers the underlying wing which is therefore no longer arranged in contact with the abutment element 29, releasing the mechanical constraint and thus allowing the inner container 4 to slide relative to the outer container 5. When the pack 1 of cigarettes is completely closed, or rather, when the inner container 4 is completely arranged in the inner container 5, the locking system 28 is reactivated (as illustrated in FIGS. 1 and 5) in an automatic and autonomous manner due to the elastic return of the wing 30 which abuts against the abutment element 29.

During the opening movement of the inner container 4, the edges 26 of the stop tabs 23 form a mechanical stop against which the edges 25 of the stop tabs 16 are arrested and when the inner container 4 is in the open position they cause an end of stroke of the sliding of the inner container 4 relative to the outer container 5, preventing the complete exiting of the inner container 4 from the outer container 5.

The inner 4 and outer 5 containers of the pack 1 of cigarettes illustrated in FIGS. 1-6 are obtained starting from respective blanks 36 and 37 illustrated in FIGS. 7-16.

With reference to FIGS. 7-9 and 12-14, the blank 36 has two pre-weakened longitudinal folding lines 38 and a plurality of pre-weakened transverse folding lines 39, which define, between the two pre-weakened longitudinal folding lines 38, a panel 7' that forms one of the side walls 7, a panel 6' that forms the lower wall 6 and a panel 7" that forms the other side wall 7. The panel 7' has on one side an outer panel 8' that forms the respective outer part of the rear wall 8 and on the opposite side an outer panel 9' that forms the respective outer part of the front wall 9. The panels 8' and 9' are arranged on opposite sides of the panel 7', and are separated from the panel 7' by the pre-weakened longitudinal folding lines 38.

The panel 7" has on one side an inner panel 8" which forms the respective inner part of the rear wall 8 and on the opposite side an inner panel 9" which forms the respective inner part of the front wall 9. The panels 8" and 9" are arranged on opposite sides of the panel 7", and are separated from the panel 7" by the pre-weakened longitudinal folding lines 38. The panels 8" and 9" have a pair of wings 40, each of which is separated from the respective panel 8" or 9" by a pre-weakened transverse folding line 39. Inside each panel 7' and 7" a respective stop tab 16 partially surrounded by a corresponding hole 27, is provided.

As illustrated in FIGS. 7-9 and 12-14, the blank 36 comprises a panel 13' which forms the outer part of the upper wall 13 of the closing tab 11, a panel 12' which forms one of the side walls 12 of the closing tab 11, is adjacent to the panel 13' and 7' and is separated therefrom by a transverse folding line 42 and by the tear-off separation line 14, respectively, a panel 12" which forms the other side wall 12 of the closing tab 11, is adjacent to the panel 7" and is separated therefrom by the tear-off separation line 14, and a panel 13" which forms the inner part of the upper wall 13 of the closing tab 11, which is adjacent to the panel 12" and is separated therefrom by the pre-weakened transverse folding line 42. This last pre-weakened transverse folding line 42 acts as a hinge 15 in the event that the user decides not to completely separate the closing tab 11 from the inner container 4.

The blank 36 illustrated in FIGS. 7-9 is used to make the outer container 5 of packs with a sliding opening in which the inner container 4 rotates relative to the outer container 5. While, the blank 36 illustrated in FIGS. 12-14 is used to make the outer container 5 of packs with a sliding opening in which the inner container 4 translates relative to the outer container 5.

Therefore, the blank 36 illustrated in FIGS. 7-9 differs from the blank 36 illustrated in FIGS. 12-14 due to the fact that it comprises a panel 6" which is adjacent to the panel 6' and is separated therefrom by a pre-weakened longitudinal folding line 41. The panel 6" is folded by 180° against the panel 6'. A part of the lower wall 17 of the outer container 5 is glued to the panel 6". Therefore, the pre-weakened transverse folding line 41 acts as a hinge for the inner container 4 when it rotates relative to the outer container 5 to be arranged in the open position.

The blank 36 illustrated in FIGS. 12-14 does not comprise the panel 6".

With reference to FIGS. 10, 11, 15 and 16, the blank 37 has two pre-weakened transverse folding lines 43 and a plurality of pre-weakened longitudinal folding lines 44, which define, between the two pre-weakened transverse folding lines 43, a panel 19' forming a side wall 19, a panel 20' forming the rear wall 20, and a panel 19" forming the other side wall 19. Each panel 19' or 19" has a respective stop tab 23, which is arranged on the opposite side relative to the panel 20' and is separated from the respective panel 19' or 19" by a pre-weakened longitudinal folding line 44.

The panel 19' has the two outer panels 17' and 18', which are arranged on opposite sides of the panel 19', are separated from the panel 19' by the pre-weakened transverse folding lines 43 and form an outer part of the walls 17 and 18. The outer panel 18' has, furthermore, a wing 45 configured to be folded by 90° around the pre-weakened longitudinal folding line 44 and overlaps and is glued on the inside of the panel 20'. The panel 20' has the hole 22 and a side panel 17''' adjacent to the panel 20' and separated therefrom by the pre-weakened transverse folding line 43.

The panel 19" has the two inner panels 17" and 18", which are arranged on opposite sides of the panel 19", are separated from the panel 19" by the pre-weakened transverse folding lines 43 and form an inner part of the walls 17 and 18. The panels 17" and 17''' are shaped so as not to overlap each other once folded against the panel 17' to define the lower wall 17 of the outer container 5.

Figure 10:
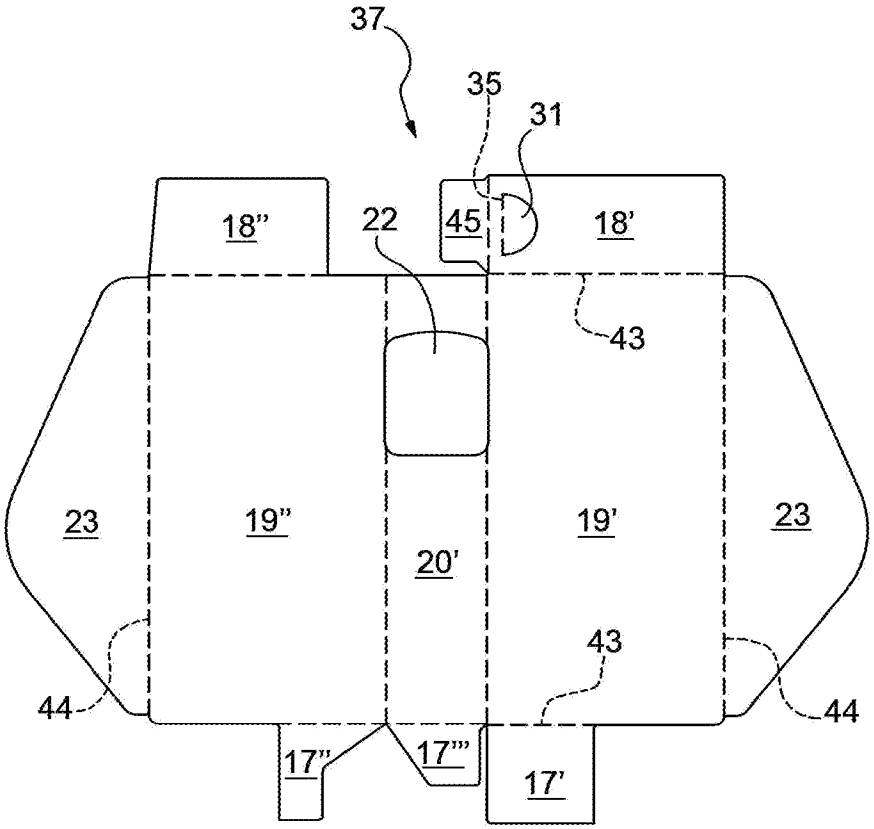
FIG. 10 is a plan view of a blank used to make the inner container of the pack of FIG. 2 and obtained according to a first embodiment.

In the embodiment illustrated in FIGS. 10 and 11, the outer panel 18' has a size measured parallel to the pre-weakened transverse folding line 43 substantially equal to the size measured parallel to the pre-weakened transverse folding line 43 of the panel 19'. While, the outer panel 17' and the inner panels 17" and 18" have the size measured parallel to the pre-weakened transverse folding line 43 lesser than the size of the respective panel 19' or 19" measured parallel to the pre-weakened transverse folding line 43. In the embodiment illustrated in FIGS. 15 and 16, the outer panels 17' and 18' and the inner panel 17" have the size measured parallel to the pre-weakened transverse folding line 43 substantially equal to the size of the panel 19' or 19" measured parallel to the pre-weakened transverse folding line 43. In particular, the inner panel 17" has a trapezoidal shape and therefore has a substantially equal size only at the pre-weakened transverse folding line 43. While, the inner panel 18" has the size measured parallel to the pre-weakened transverse folding line 43 lesser than the size measured parallel to the pre-weakened transverse folding line 43 of the adjacent panel 19".

With reference to FIGS. 10, 11, 15 and 16, it should be noted that the size of the panel 18" (measured as stated above) is lesser than the size of the panel 19" (measured as stated above) by an amount equal to the size of the wing 30 measured perpendicular to the rear wall 8.

As illustrated in FIGS. 11 and 16, the inner panel 18" has a twin reinforcement panel 18''' which is hinged to the inner panel 18", overlaps and is glued to the inner panel 18", and helps to strengthen the abutment element 29. Substantially, according to this embodiment, the abutment element 29 is made of two overlapping panels 18" and 18'''.

In the embodiment illustrated in FIG. 2, the pack 1 of cigarettes has a sliding opening by means of a rotational movement; that is, the inner container 4 moves relative to the outer container 5 and between the opening and closing positions by means of a rotational movement (i.e. a movement around the pre-weakened transverse folding line 41 which acts as a hinge). In particular, the panel 6" of the inner container 4 is connected to the outer container 5. Whereas, in the embodiment illustrated in FIG. 3, the pack 1 of cigarettes has a sliding opening by means of a translation movement; i.e. the inner container 4 moves relative to the outer container 5 and between the opening and closing positions by means of a linear movement along a direction parallel to the larger transverse edges.

In other words, the difference between the pack 1 of cigarettes illustrated in FIG. 2 and the pack 1 of cigarettes illustrated in FIG. 3 is the fact that in the pack 1 of cigarettes illustrated in FIG. 2 the inner container 4 is hinged (i.e. connected) to the outer container 5 at the pre-weakened transverse folding line 41, while in the pack 1 of cigarettes illustrated in FIGS. 1-3 the inner container 4 is only inserted inside the outer container 5 without, however, there being any type of reciprocal connection between the two containers 4 and 5. Thanks to this difference, in the pack 1 of cigarettes illustrated in FIG. 2 the sliding between the two containers 4 and 5 occurs by means of a rotation around the pre-weakened transverse folding line 41, while in the pack 1 of cigarettes illustrated in FIG. 3 the sliding between the two containers 4 and 5 occurs by means of a linear movement.

Furthermore, since the inner container 4 is kept in the closed position by the locking system 28, it is not necessary to provide any kind of interference between the inner container 4 and the outer container 5 when the inner container 4 is in the closed position.

In the embodiments illustrated in the attached Figures, the longitudinal and transverse edges are straight; alternatively, the longitudinal and/or transverse edges could be rounded or bevelled.

The embodiments described herein can be combined with each other without departing from the scope of the present invention.

The pack 1 of cigarettes described above has numerous advantages.

Figure 6:
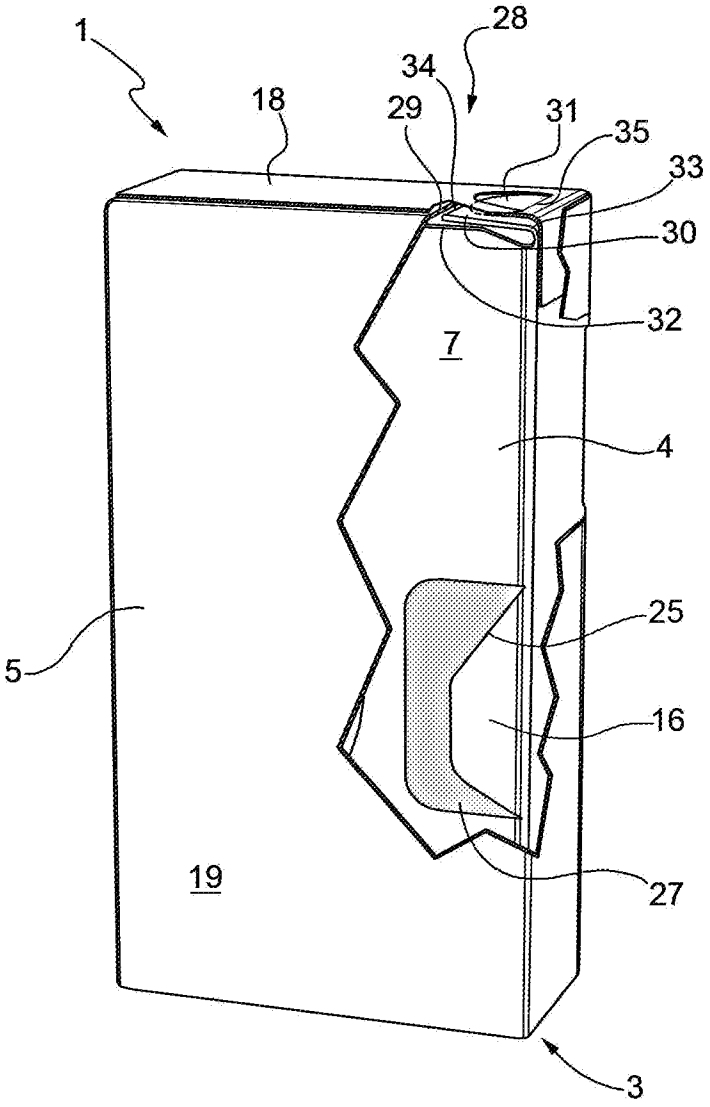
FIG. 6 is a perspective view, with some parts removed for clarity, of the pack of cigarettes of FIG. 1 with the locking system deactivated.

Firstly, the pack 1 of cigarettes described above can be classified as "child-proof", i.e. able to prevent children from opening, because it has the locking system 28 which locks, in a manner that can be deactivated by an outer action of the user, the sliding of the inner container 4 relative to the outer container 5 when the inner container 4 is in the closed position. In fact, to open the pack 1 of cigarettes described above it is not sufficient to extract the inner container 4 from the outer container 5 but it is necessary to actuate, that is to say, compress the wing 31, which in turn acts on the wing 30 that, therefore, disengages the abutment element 29 by deactivating the locking system 28 (i.e. passing from what is illustrated in FIG. 5 to what is illustrated in FIG. 6). In other words, in order to open the pack 1 of cigarettes described above it is necessary to carry out a particular sequence of movements which are not intuitive for a child.

After the first opening of the pack 1 of cigarettes, when the pack 1 of cigarettes is completely closed, the locking system 28 is reactivated in an automatic and autonomous manner (as illustrated in FIG. 5).

Furthermore, the pack 1 of cigarettes described above, although classifiable as "child-proof", nevertheless has relatively simple and banal opening methods for an adult.

The pack 1 object of the present invention has the advantage that it cannot be opened involuntarily, for example by holding the pack from the outer container 5 or by applying a lateral compression caused by the housing, for example in a bag or a trouser or jacket pocket. Rather, the opening of pack 1 is a consequence of a combination of movements that the user deliberately carries out to open the pack.

Furthermore, the pack 1 has the advantage that since the locking system 28 is arranged at the upper wall 18, it does not interfere with the stop tabs 16 which act as end of stroke. This also greatly simplifies the handling of blanks 36 and 37 during production.

Finally, the pack 1 of cigarettes described above can be produced in a packing machine which does not differ from a standard packing machine for a pack of cigarettes of the sliding type consequently, the preparation of a packing machine for the production of the pack 1 of cigarettes described above does not require additional costs.

LIST OF REFERENCE NUMBERS OF THE FIGURES

1 pack of cigarettes
2 wrapped group
3 outer casing
4 inner container
5 outer container
6 lower wall
7 side wall
8 rear wall
9 front wall
10 extraction opening
11 closing tab
12 side wall
13 upper wall
14 separation line
15 hinge
16 stop tab
17 lower wall
18 upper wall
19 side wall
20 rear wall
21 opening
22 hole
23 stop tab
24 hole
25 edge
26 edge
27 hole
28 locking system
29 abutment element
30 wing
31 wing
32 edge
33 hinge
34 free end
35 hinge
36 blank
37 blank
38 folding line
39 folding line
40 wing
41 folding line
42 folding line
43 folding line
44 folding line
45 wing

The invention claimed is:

1. A pack (1) for smoking articles comprising:

a group (2) of smoking articles;

an inner container (4), which houses the group (2) of smoking articles;

an outer container (5), which houses, on the inside and in a sliding manner, the inner container (4) so as to allow the inner container (4) to slide relative to the outer container (5) between a closed position, in which the inner container (4) is completely inserted inside the outer container (5), and an open position, in which the inner container (4) is partially extracted from the outer container (5); and a locking system (28) which prevents the inner container (4) from sliding from the closed position to the open position, can be deactivated by means of an external action of the user, who allows the inner container (4) to slide from the closed position to the open position, and can be reactivated by moving the inner container (4) from the open position to the closed position; the locking system (28) comprises: an abutment element (29), which is integral with the outer container (5) and is arranged inside the outer container (5); a first wing (30), which is integral with the inner container (4), is movable relative to the inner container (4) and is configured to abut against the abutment element (29) of the outer container (5) when the inner container (4) is in the closed position, thus preventing the inner container (4) from sliding from the closed position to the open position; and a second wing (31), which is obtained on the outer container (5), is arranged at the first wing (30) and is movable relative to the outer container (5) so as to be pressed inwards and, hence, move the underlying first wing (30) accordingly in order to release the first wing (30) abutting against the abutment element (29) and, by so doing, allow the inner container (4) to slide from the closed position to the open position;

wherein:

the first wing (30) is hinged to a rear wall (8) of the inner container (4) along a hinge (33), the rear wall (8) extends along a direction parallel to the prevailing development direction of the pack (1) and the first wing (30) normally protrudes outwards from an upper end of the inner container (4), and the second wing (31) is obtained at an upper wall (18) of the outer container (5), which is transversal to a prevalent development direction of the pack (1), so as to at least partially overlap the first wing (30); and the abutment element (29) is obtained at an inner surface of the upper wall (18) of the outer container (5).

2. The pack (1) according to claim 1, wherein the first wing (30) has at least one portion having a size transversal to the prevailing development direction of the pack (1) which is greater than a transverse size of the rear wall (8) of the inner container (4) by an amount comprised between 0.5 and 1.5 millimetres.

3. The pack (1) according to claim 1, wherein:

the upper wall (18) of the outer container (5) is formed by a first outer panel (18') and by a first inner panel (18") which overlap and are glued to one another; and the abutment element (29) is defined by a transverse edge of the first inner panel (18").

4. The pack (1) according to claim 2, wherein the first inner panel (18") has an extension which is smaller than the extension of the first outer panel (18') by an amount equal to the extension of the first wing (30) of the locking system (28).

5. The pack (1) according to claim 4, wherein the first inner panel (18") has a reinforcement panel (18'") which is hinged to the first inner panel (18"), is overlapped and glued to the first inner panel (18") and helps to strengthen the abutment element (29).

6. The pack (1) according to claim 1, wherein:

the first wing (30) is hinged to a wall (8) of the inner container (4) which is formed by a second outer panel (8') and by a second inner panel (8") which overlap and are glued to one another; and the first wing (30) is exclusively hinged to the second inner panel (8").

7. The pack (1) according to claim 1, wherein:

the rear wall (8) of the inner container (4) formed by a second outer panel (8') and by a second inner panel (8") which overlap and are glued to one another; and the first wing (30) is exclusively hinged to the second outer panel (8').

8. The pack (1) according to claim 1, wherein:

the rear wall (8) of the inner container (4) is formed by a second outer panel (8') and by a second inner panel (8") which overlap and are glued to one another; and the first wing (30) is formed by an inner portion (30") which is hinged to the second inner panel (8") and by an outer portion (30') which is hinged to the second outer panel (8') and overlaps and is glued to the inner portion (30").

* * * * *